US007401655B2

(12) United States Patent
Vandevier et al.

(10) Patent No.: US 7,401,655 B2
(45) Date of Patent: Jul. 22, 2008

(54) DOWNHOLE GAS COMPRESSOR

(75) Inventors: Joseph E. Vandevier, Claremore, OK (US); John L. Bearden, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 378 days.

(21) Appl. No.: 11/180,925

(22) Filed: Jul. 7, 2005

(65) Prior Publication Data

US 2007/0007013 A1 Jan. 11, 2007

(51) Int. Cl.
*E21B 43/00* (2006.01)

(52) U.S. Cl. ..... 166/372; 166/369; 166/250.07

(58) Field of Classification Search ..... 166/369, 166/372, 250.07
See application file for complete search history.

(56) References Cited

U.S. PATENT DOCUMENTS 4,623,305 A * 11/1986 Segerstrom ..... 417/365
4,928,771 A * 5/1990 Vandevier ..... 166/385
5,605,193 A 2/1997 Bearden et al.
5,755,288 A 5/1998 Bearden et al.
6,123,149 A * 9/2000 McKinzie et al. ..... 166/266
6,413,065 B1 7/2002 Dass
6,601,652 B1 8/2003 Grant
7,172,020 B2 * 2/2007 Tseytlin ..... 166/250.07

OTHER PUBLICATIONS

Brochure of CAN-K PME, Artificial Lift Systems Inc. [Canada], *Artificial Lift Solution: Surface Transfer Twin Screw Multiphase Pumps*, www.can-k.com, date unknown.

* cited by examiner

*Primary Examiner*—Giovanna C Wright
(74) *Attorney, Agent, or Firm*—Bracewell & Giuliani LLP

(57) ABSTRACT

A method for producing gas from a well with low pressure involves running a bottom hole pressure test to graph a P-Q curve. The operator computes a frictional pressure drop due to friction of the gas flowing through the production tubing to the surface. A packer is set above perforations in the well. A screw pump is selected that has a capacity equal to the sum of the frictional pressure drop plus a desired wellhead pressure. The screw pump has a flow rate capacity determined from the P-Q curve. The operator may vary the frequency of a downhole motor to achieve the desired wellhead pressure.

17 Claims, 2 Drawing Sheets

DOWNHOLE GAS COMPRESSOR

FIELD OF THE INVENTION

This invention relates in general to producing gas from low pressure wells, and in particular to an artificial lift system for such wells.

BACKGROUND OF THE INVENTION

A gas well has casing with perforations or an open hole completion below the casing. Typically the gas well has a string of tubing with a packer located above the perforations, although in some wells, a packer is not employed. The gas flows from a gas producing zone up the tubing to the wellhead and into a pipeline.

A desired minimum pressure is required at the surface or wellhead for delivery into the gas pipeline. A pressure drop due to frictional losses occurs as the gas flows from the perforations up the tubing. In wells that have been partially depleted, the pressure at the producing zone may be insufficient to overcome the frictional pressure drop and still achieve the desired wellhead pressure.

Compressors are commonly used at the surface of low pressure gas wells for creating a negative pressure at the wellhead to enhance gas flow and for compressing the gas at the wellhead to achieve the desired wellhead pressure. The compressor may be a turbine type, a liquid ring type, or a screw pump. A screw pump has at least two rotors with helical profiles formed thereon. The helical profiles interleave each other. One of the rotors is driven, which causes the other to rotate. A screw pump is capable of pumping multi-phase fluids. Turbine type compressors are generally not capable of multi-phase production, thus for gas wells that produce a significant amount of liquid, the liquids are normally separated from the well fluid before reaching the turbine type compressor.

As an alternative to surface compressors, it has also been proposed to a connect a downhole motor to a turbine gas compressor and lower the assembly into a gas well for compressing the gas downhole. A variable speed power supply may be used at the surface to vary the speed of the motor. While these various systems are workable with low pressure gas wells, improvements in efficiency are desired.

SUMMARY OF THE INVENTION

In a method of this invention, the operator performs a bottom hole pressure versus flow rate test of a gas producing zone and graphs a pressure-flow (P-Q) curve. The operator also computes a pressure drop due to friction of the gas flowing through production tubing from the production zone to the surface. The operator optionally sets a packer above the perforations or open hole completion below the casing.

The operator selects a compressor with a pressure capacity that will produce at a selected speed a design pressure that is the sum of the frictional pressure drop plus a desired wellhead pressure. The design flow rate capacity is determined by where the design pressure intersects the P-Q curve for the particular well. The operator selects a compressor based on the compressor performance curve. The compressor performance curve informs the operator at what speed the compressor must be operated to achieve the desired pressure and flow rate.

The operator lands the compressor and motor in the well and supplies power to the motor at the selected speed with a variable frequency drive unit at the surface. Preferably, the compressor is a multi-phase type, such as a screw pump, for also pumping any liquids being produced.

DETAILED DESCRIPTION OF THE PREFERRED EMBODIMENT

Figure 1:
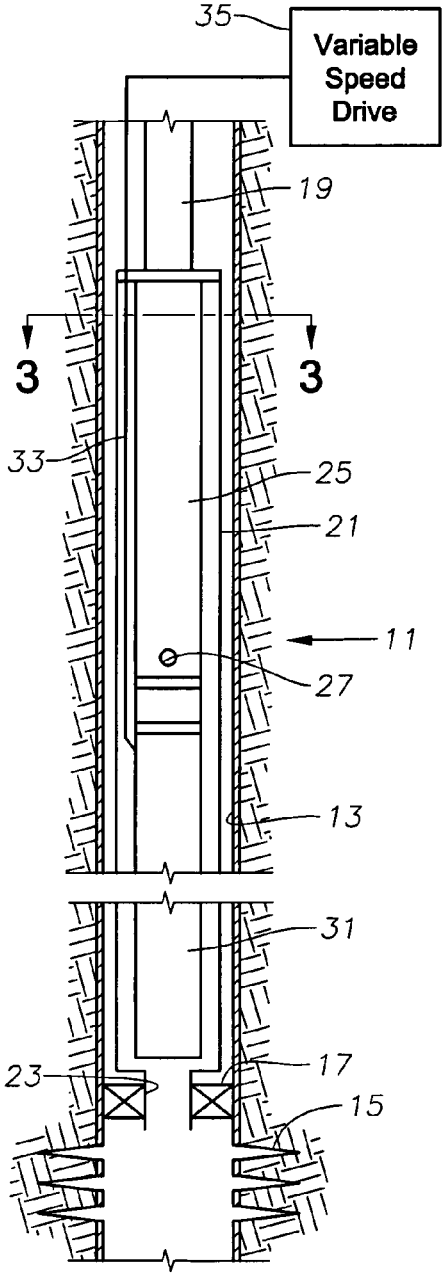
FIG. 1 is a schematic view illustrating a gas well having a screw pump assembly constructed in accordance with this invention.

Referring to FIG. 1, well 11 has a casing 13 containing a set of perforations 15 leading into a gas producing zone. In lieu of perforations 15, an open hole completion area could exist below casing 13. The gas producing zone may also produce some liquids. A packer 17 may optionally be set in casing 13 above perforations 15. A string of tubing 19 extends from the surface and, in this embodiment, supports a shroud 21. Shroud 21 has a tail pipe 23 that stabs sealingly into a polished bore of packer 17. Alternately, packer 17 could be eliminated and the annulus surrounding tubing 19 closed at the top of the well.

A compressor 25, preferably a multi-phase type such as a screw pump, is located within shroud 21 and connected to tubing 19. Compressor 25 has an intake 27 for receiving well fluid flowing from perforations 15. An electrical motor 31 is secured to the lower end of compressor 25 in this embodiment. Motor 31 is preferably a three-phase AC motor that is filled with a dielectric lubricant. A pressure equalizing section may be located between motor 31 and compressor 25 for equalizing the internal lubricant pressure with the hydrostatic pressure of any liquid that might occur in the well. A power cable 33 extends from motor 31 to the surface. In this embodiment, a variable speed drive 35 supplies a variable frequency to motor 31 to vary the speed of rotation of compressor 25.

Figure 2:
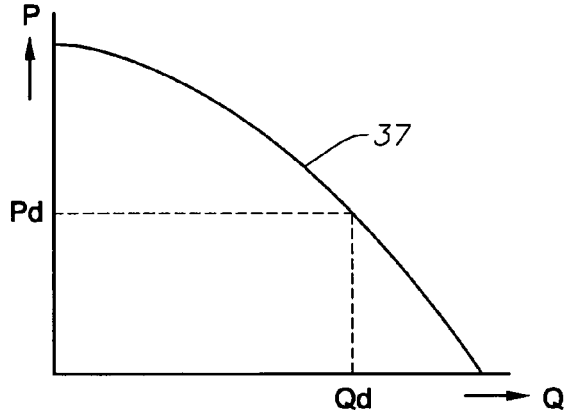
FIG. 2 is a schematic view of a P-Q curve for the well of FIG. 1.

Referring to FIG. 2, prior to installing compressor 25, the operator performs a test of the well by lowering a measuring instrument into casing 13 to a point adjacent perforations 15. The instrument may be a conventional type capable of measuring pressure and flow rates of the well fluid at perforations 15. The instrument may be run a variety of ways. It could be run on a string of tubing, such as production tubing 19 or coiled tubing. The instrument could be run on a line or on coiled tubing. The instrument may be a type that has a battery and a memory unit for recording pressure and flow rates. Alternately, if ran on line that has an electrical conductor, the instrument could be powered by a power source at the surface and could transmit the readings to the surface over the conductor while the survey is being made.

During the survey, the operator will record the bottom hole pressure of the well under static or shut-in conditions. For the system of this invention, preferably the bottom hole pressure at shut-in is less than 150 psi. The operator preferably incrementally opens an orifice at the test unit and records the pressure drop. If the well has sufficient pressure to flow the gas through a test string of tubing to the surface, the orifice could be a choke at the wellhead. At shut-in pressure with zero flow rate, the maximum bottom hole pressure will be recorded. With the orifice completely open, a maximum flow rate will be recorded. Being a gas well, casing 13 will not contain a column of liquid which otherwise would exert a hydrostatic pressure on the production zone and inhibit gas flow. The data points recorded by the operator are plotted to form P-Q curve 37 (FIG. 2), which is a unique characteristic for each well 11.

The operator will calculate the pressure drop that would occur due to the frictional effects of the gas flowing from perforations 15 up tubing 19 to the wellhead. This pressure drop is calculated by known methods utilizing the diameter of tubing 15 and the type of fluid flowing from perforations 15.

The desired wellhead pressure will be known, and for the system of this invention, it is normally between about 20 and 60 psi. Compressor 25 must be capable of achieving a design pressure that will equal the sum of the pressure drop plus the desired wellhead pressure. This design pressure, shown as Pd in FIG. 2, will yield a design flow rate Qd based upon P-Q curve 37. A line drawn parallel to the x-axis from the design pressure Pd intersects P-Q curve 37. A line drawn from the point of intersection parallel to the y-axis will disclose the design flow rate at that particular Pd.

The operator selects a compressor 25 that has the capabilities of producing the desired pressure and the design flow rate. The selection is based on performance characteristics provided by manufacturers of compressors and also the expected amount of liquids contained in the well fluid. If an appreciable amount of liquid is expected, preferably compressor 25 is a multi-phase type, such as a screw pump. The performance characteristics of the compressor 25 selected will inform the operator what speed compressor 25 should be operated in order to achieve the desired Qd and Pd. By using the variable speed drive 35, the operator can not only achieve the desired speed, but can monitor the pressure of the gas at the wellhead and vary the speed of motor 31 to maintain the desired wellhead pressure.

Figure 3:
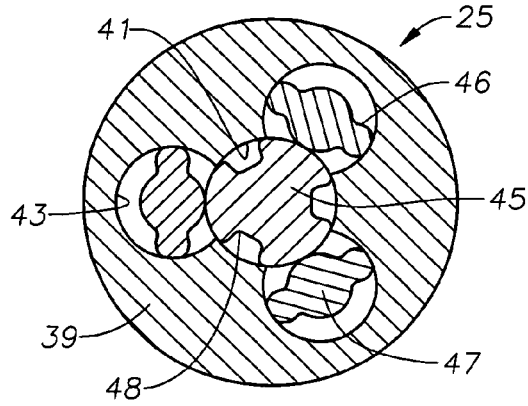
FIG. 3 is an enlarged sectional view of the screw pump of FIG. 1 taken along the line 3-3 of FIG. 1.

FIGS. 3 and 4 disclose one embodiment of a preferred compressor 25. Compressor 25 is a screw pump with a body 39 having a central axial borehole 41. With this embodiment, three satellite boreholes 43 are symmetrically located about an intersecting central borehole 41. The number of satellite boreholes 43 could be one or more. A main rotor 45 is located in central borehole 41. A satellite rotor 47 is located in each satellite borehole 43.

Figure 4A:
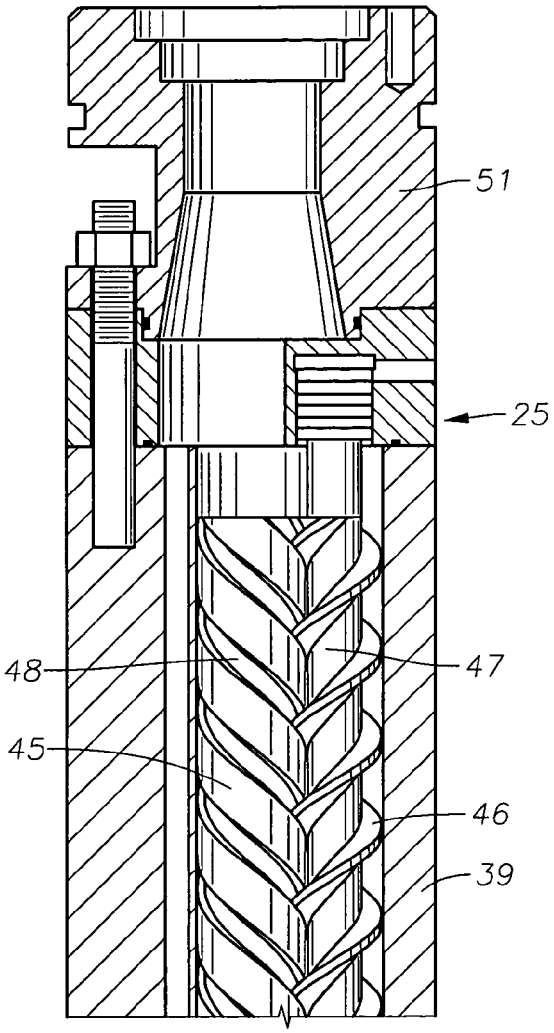
FIGS. 4A and 4B comprise a vertical sectional view of the screw pump of the pump assembly of FIG. 1.
Figure 4B:
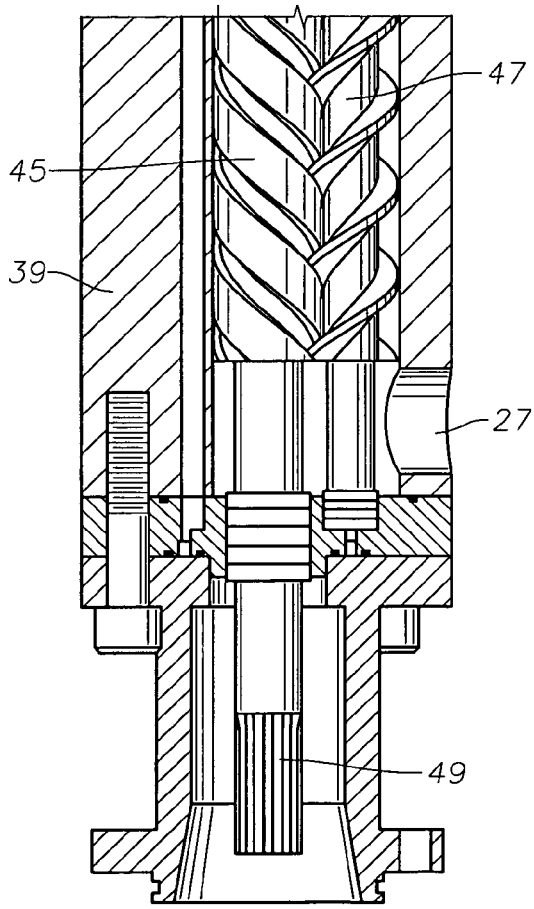

As shown in FIGS. 4A and 4B, each satellite rotor 47 has a helical profile 46 that interleaves with a helical profile 48 formed in main rotor 45. As shown in FIG. 4B, a shaft extends from main rotor 45 for engagement by a mating shaft (not shown) of motor 31 (FIG. 1). A discharge adapter 51 is located at the upper end of compressor 25 for connecting to production tubing 19 (FIG. 1).

In operation, the operator will set packer 17 above perforations 15. The operator lowers compressor 25 and motor 31 on tubing 19. The tail pipe 23 of shroud 21 stabs into a receptacle in packer 17. The operator supplies power from variable speed drive 35 to cause motor 31 to rotate compressor 25. The rotation creates a suction that draws gas into shroud 21 and intake 27. Compressor 25 compresses the gas, causing it to flow through production tubing 19 to the surface. The operator preferably monitors the wellhead pressure and controls the speed by variable speed drive 35 to maintain the desired wellhead pressure. Any liquids being produced from perforations 15 will be produced along with gas by compressor 25. Well 11 preferably is primarily a gas well, and if compressor 25 is capable of multi-phase pumping, the small amount of liquid produced will not be detrimental to compressor 25. There is no need for a downhole liquid/gas separator in the preferred embodiment. A surface separator may be used to separate any liquid at the wellhead.

The invention has significant improvements. Selecting a downhole compressor based on a P-Q test of the well reduces the chances of inefficient over sizing. Being located adjacent the perforations, the compressor is more efficient than if located at the surface. Downhole liquid/gas separation is not required if a multi-phase compressor, such as a screw pump, is used.

While the invention has been shown in only one of its forms, it should be apparent to those skilled in the art that it is not so limited but is susceptible to various changes without departing from the scope of the invention. For example, although a shroud is deployed, other configurations may be utilized. The motor could be located above the pump with a bypass area for gas flow to the production tubing. A turbine compressor might be substituted for the screw pump in some installations.

We claim:

1. A method for producing a gas well, comprising:

(a) selecting a well having a production zone;

(b) performing a bottom hole pressure versus flow rate test of the production zone while the well is free of a column of liquid above the production zone and graphing a pressure versus flow rate curve by varying a flow area of an orifice through which gas flows from the production zone, measuring a pressure and flow rate of the gas flowing from the production zone at the different flow areas of the orifice;

(c) computing a frictional pressure drop due to friction of the well fluid flowing through a production tubing from the production zone to the surface;

(d) selecting a compressor having at a selected speed a design pressure at least equal to a sum of the frictional pressure drop plus a desired wellhead pressure and a design flow rate based on the pressure versus flow rate curve;

(e) operatively connecting a motor to the compressor, securing the compressor and motor to a string of production tubing, and lowering the motor and the compressor into the well after the pressure versus flow rate curve has been made;

(f) supplying power to the motor and rotating the compressor at the selected speed, which creates a suction to draw gas from the production zone into the compressor; and (g) compressing the gas with the compressor and conveying the gas up the production tubing.

2. The method according to claim 1, wherein step (a) comprises selecting a well having a bottom hole pressure at shut-in that is not substantially greater than 150 psi.

3. The method according to claim 1, wherein step (d) comprises selecting a compressor capable of pumping multi-phase well fluid.

4. The method according to claim 1, wherein:

step (d) comprises selecting a screw pump to serve as the compressor.

5. The method according to claim 1, wherein;

step (e) comprises connecting a three-phase electrical motor to the compressor; and step (f) comprises varying a frequency of power supplied to the motor to achieve the desired speed.

6. The method according to claim 1, wherein:

the compressor of step (d) comprises a screw pump having at least one screw; and step (f) comprises rotating the screw with the motor.

7. The method according to claim 1, wherein:

step (g) comprises pumping with the compressor any liquid being produced by the production zone up the production tubing along with the gas.

8. The method according to claim 1, wherein:

step (e) comprises connecting a three-phase electrical motor to the compressor;

step (f) comprises monitoring the wellhead pressure of the gas flowing up the production tubing and varying a frequency of power supplied to the motor to achieve the desired wellhead pressure.

9. The method according to claim 1, further comprising setting a packer in the well; and step (e) comprises landing the motor and the compressor in the packer.

10. A method for producing gas, comprising:

(a) selecting a well having a gas production zone;

(b) performing a pressure versus flow rate test of the production zone while the well is free of a column of liquid above the gas production zone and graphing a pressure versus flow rate curve by causing the gas to flow from the production zone through a downhole orifice, varying a flow area of the orifice and recording the pressure and the flow rate of the gas as it flows through the orifice at the different flow areas;

(c) computing a frictional pressure drop of the gas due to friction of the gas flowing through production tubing from the production zone to the surface;

(d) selecting a screw pump having a design pressure capability equal to sum of the frictional pressure drop plus a desired wellhead pressure and a flow rate capacity at based on the pressure versus flow rate curve;

(e) operatively connecting a motor to the screw pump, securing the screw pump and the motor to a string of production tubing, and lowering the motor and the screw pump into the well after the pressure versus flow rate curve has been made;

(f) supplying power to the motor and rotating the screw pump, the screw pump drawing gas from the production zone, compressing the gas and conveying the gas up the production tubing; and (g) monitoring the wellhead pressure of the gas flowing up the production tubing and varying the speed of the motor to achieve the desired wellhead pressure.

11. The method according to claim 10, wherein step (a) comprises selecting a well having a bottom hole pressure at shut-in that is not substantially greater than 150 psi.

12. The method according to claim 10, wherein:

step (f) comprises with the screw pump, pumping any liquid flowing from the production zone up the production tubing along with the gas.

13. The method according to claim 10, further comprising setting a packer in the well; and step (e) comprises landing the motor and the compressor in the packer.

14. A gas well, comprising:

a casing in communication with a gas production zone;

the well having a pressure versus flow rate curve characteristic based on a bottom hole pressure versus flow rate and made while the casing is free of a column of liquid above the gas production zone;

a screw pump and downhole electrical motor suspended on a string of tubing in the casing;

the string of tubing having a computed frictional pressure drop based on the characteristics of the tubing and the gas of the production zone; and the screw pump having at a selected speed a design pressure equal to a sum of the frictional pressure drop plus a desired wellhead pressure, and a design flow rate determined by the pressure versus flow rate curve characteristic of the well.

15. The well according to claim 14, wherein the well has a bottom hole pressure at shut-in that is not substantially greater than 150 psi.

16. The well according to claim 14, further comprising a variable frequency power supply for supplying power to the motor at a frequency selected to a achieve a desired speed.

17. The well according to claim 14, further comprising:

a packer set in the casing; and wherein the screw pump and electrical motor are landed in the packer.

* * * * *